US006681854B2

(12) United States Patent
Danos

(10) Patent No.: US 6,681,854 B2
(45) Date of Patent: Jan. 27, 2004

(54) SAND SCREEN WITH COMMUNICATION LINE CONDUIT

(75) Inventor: Jake A. Danos, Stafford, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/981,072

(22) Filed: Oct. 16, 2001

(65) Prior Publication Data

US 2002/0053439 A1 May 9, 2002

Related U.S. Application Data

(60) Provisional application No. 60/245,515, filed on Nov. 3, 2000.

(51) Int. Cl.[7] ..... E21B 43/04; E21B 43/14

(52) U.S. Cl. ..... 166/227; 166/5

(58) Field of Search ..... 166/278, 227, 166/228, 230, 236, 51, 380

(56) References Cited

U.S. PATENT DOCUMENTS

| | | | | |
|---|---|---|---|---|
| 5,918,672 | A * | 7/1999 | McConnell et al. | 166/223 |
| 6,220,345 | B1 * | 4/2001 | Jones et al. | 166/51 |
| 2002/0007948 | A1 * | 1/2002 | Bayne et al. | 166/278 |
| 2002/0125009 | A1 * | 9/2002 | Wetzel et al. | 166/278 |
| 2002/0129935 | A1 * | 9/2002 | Castano-Mears et al. | 166/227 |

* cited by examiner

*Primary Examiner*—William Neuder
(74) *Attorney, Agent, or Firm*—Trop Pruner & Hu P.C.; Jeffrey E. Griffin; Brigitte Jeffery Echols

(57) ABSTRACT

A sand screen having a shroud with a channel for routing of a control line and associated methods and systems. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims.

39 Claims, 3 Drawing Sheets

SAND SCREEN WITH COMMUNICATION LINE CONDUIT

CROSS REFERENCE TO RELATED APPLICATIONS

The following is based on and claims the priority of provisional application No. 60/245,515 filed Nov. 3, 2000.

BACKGROUND OF THE INVENTION

1. Field of the Invention

The present invention relates to the field of sand screens used to complete subterranean wells and, more specifically, to devices and methods used for routing control lines with a sand screen.

2. Description of Related Art

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production of oil and gas can begin.

Sand or silt flowing into the wellbore from unconsolidated formations can lead to an accumulation of fill within the wellbore, reduced production rates and damage to subsurface production equipment. Migrating sand has the possibility of packing off around the subsurface production equipment, or may enter the production tubing and become carried into the production equipment. Due to its highly abrasive nature, sand contained within production streams can result in the erosion of tubing, flowlines, valves and processing equipment. The problems caused by sand production can significantly increase operational and maintenance expenses and can lead to a total loss of the well.

One means of controlling sand production is the placement of relatively large grain sand (i.e., "gravel") around the exterior of a slotted, perforated, or other type liner or sand screen. The gravel serves as a filter to help assure that formation fines and sand do not migrate with the produced fluids into the wellbore. In a typical gravel pack completion, a sand screen is placed in the wellbore and positioned within the unconsolidated formation that is to be completed for production. The sand screen is typically connected to a tool that includes a production packer and a cross-over, and the tool is in turn connected to a work or production tubing string. The gravel is mixed with a carrier fluid and pumped in slurry form down the tubing and through the crossover, thereby flowing into the annulus between the sand screen and the wellbore. The carrier fluid in the slurry leaks off into the formation and/or through the sand screen. The sand screen is designed to prevent the gravel in the slurry from flowing through it and entering into the production tubing. As a result, the gravel is deposited in the annulus around the sand screen where it forms a gravel pack. It is important to size the gravel for proper containment of the formation sand, and the sand screen must be designed in a manner to prevent the flow of the gravel through the sand screen.

At times it is desired to place other items within the wellbore adjacent to the sand screen, such as alternate pathway tubes or control lines. If these items are placed outside of the sand screen, they may be damaged when they and the sand screen are inserted into the wellbore. If these items are located within the longitudinal bore of the sand screen, they may interfere with the production of fluids or the subsequent running of other downhole tools.

There is a need for improved apparatus and methods that enable the inclusion of control lines and/or alternate pathway tubes adjacent to a sand screen.

SUMMARY OF THE INVENTION

One embodiment of the invention is a sand screen comprising a shroud having a channel or passageway formed therein. The sand screen can include a restraining element adapted to maintain one or more control lines within the channel. The sand screen can also include a base pipe and a screen. The shroud can be attached to the base pipe by a connecting member and can at least partially surround the screen and define a space between them. The shroud can also be perforated. At least one alternate path can be positioned within the shroud and can be positioned within the space between the shroud and the screen.

Other features and embodiments will become apparent from the following description, the drawings, and the claims.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
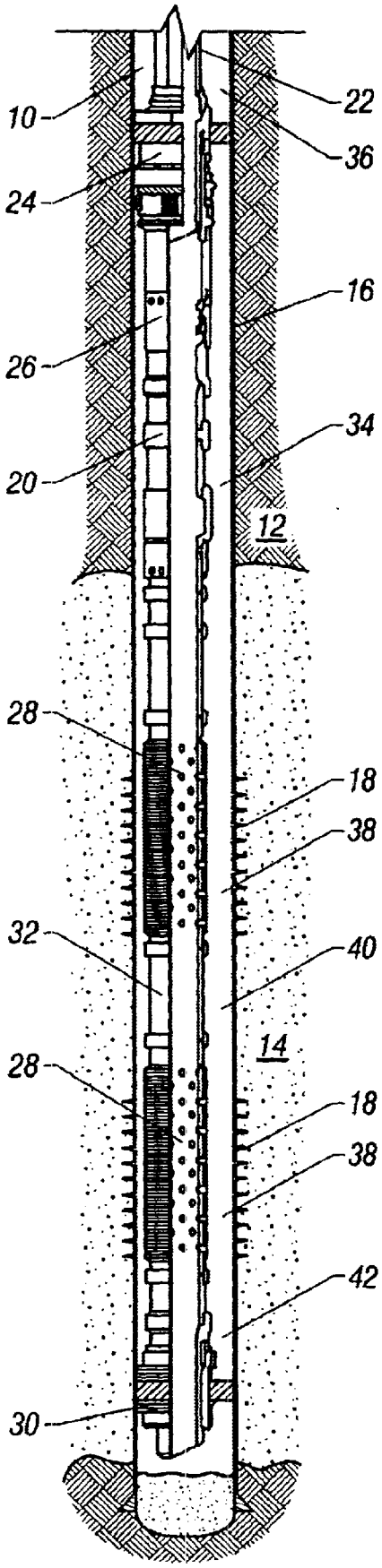
FIG. 1 (Prior Art)
FIG. 1 is a cross section of a wellbore showing a typical gravel pack completion apparatus. This illustration is of prior art.

FIG. 1 illustrates a wellbore 10 that has penetrated a subterranean zone 12 that includes a productive formation 14. The wellbore 10 has a casing 16 that has been cemented in place. The casing 16 has a plurality of perforations 18 which allow fluid communication between the wellbore 10 and the productive formation 14. A well tool 20 is positioned within the casing 16 in a position adjacent to the productive formation 14, which is to be gravel packed.

The well tool 20 comprises a tubular member 22 attached to a production packer 24, a cross-over 26, one or more sand screen elements 28 and optionally a lower packer 30. Blank sections 32 of pipe may be used to properly space the relative positions of each of the components. An annulus area 34 is created between each of the components and the wellbore casing 16. The combination of the well tool 20 and the tubular string extending from the well tool to the surface can be referred to as the production string.

In a typical gravel pack operation the packer elements 24, 30 are set to ensure a seal between the tubular member 22 and the casing 16. Gravel laden slurry is pumped down the tubular member 22, exits the tubular member through ports in the cross-over 26 and enters the annulus area 34. In one typical embodiment the particulate matter (gravel) in the slurry has an average particle size between about 40/60 mesh–12/20 mesh, although other sizes may be used. Slurry dehydration occurs when the carrier fluid leaves the slurry. The carrier fluid can leave the slurry by way of the perforations 18 and enter the formation 14. The carrier fluid can also leave the slurry by way of the sand screen elements 28 and enter the tubular member 22. The carrier fluid flows up through the tubular member 22 until the cross-over 26 places it in the annulus area 36 above the production packer 24 where it can leave the wellbore 10 at the surface. Upon slurry dehydration the gravel grains should pack tightly together. The final gravel filled annulus area is referred to as a gravel pack.

As can be seen in FIG. 1, the annulus area 38 between the screen element 28 and the casing perforations 18 has multiple fluid flow paths for slurry dehydration. The annulus area 40 between a blank section 32 and non-perforated casing does not have any direct fluid flow paths for slurry dehydration. If the blank section 32 extends more than a few feet in length, the slurry dehydration in the adjacent annulus area 40 can be greatly reduced and can lead to a void area within the resulting gravel pack.

An area that is prone to developing a void during a gravel pack operation is the annulus area 42 below the lowest screen element 28, sometimes referred to as the "sump". A gravel pack void in the sump is particularly problematic in that it can allow the gravel from above to settle and fall into the voided sump. Production of fluids from the productive formation 14 can agitate or "fluff" the gravel pack and initiate the gravel to migrate and settle within the sump 42. This can lead to the creation of voids in the annulus areas 38 adjacent to the screen elements 28 and undermine the effectiveness of the entire well completion.

The area from the top perforation to the lowest perforation can be referred to as a completion zone. For a good gravel pack completion the entire completion zone should be tightly packed with gravel and contain no void areas. One method that is used to reduce the likelihood of voids being created within the gravel pack is the use of shunt tubes or alternate flowpath tubes (shown in FIG. 2), which assist in the slurry being evenly distributed throughout the completion zone.

As used herein, the term "screen" refers to wire wrapped screens, mechanical type screens and other filtering mechanisms typically employed with sand screens. Sand screens need to be have openings small enough to restrict gravel flow, often having gaps in the 60–120 mesh range, but other sizes may be used. The screen element 28 can be referred to as a sand screen. Screens of various types are commonly known to those skilled in the art.

Figure 2:
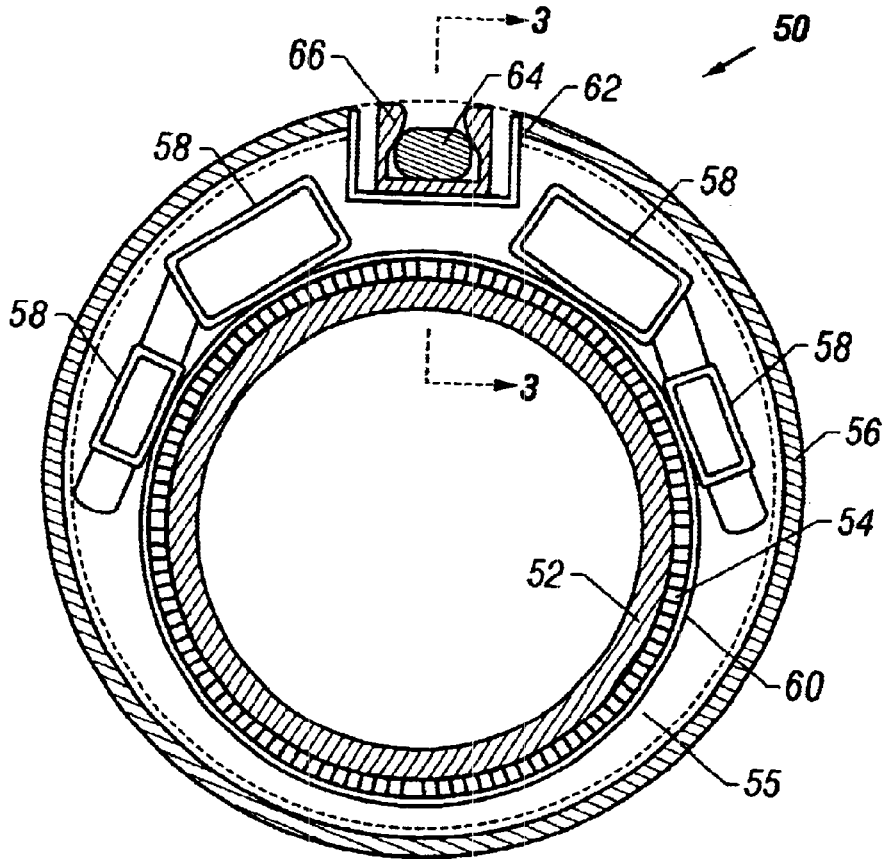
FIG. 2 is a cross sectional view of an embodiment of the invention comprising a sand screen having a control line channel formed therein.
Figure 3:
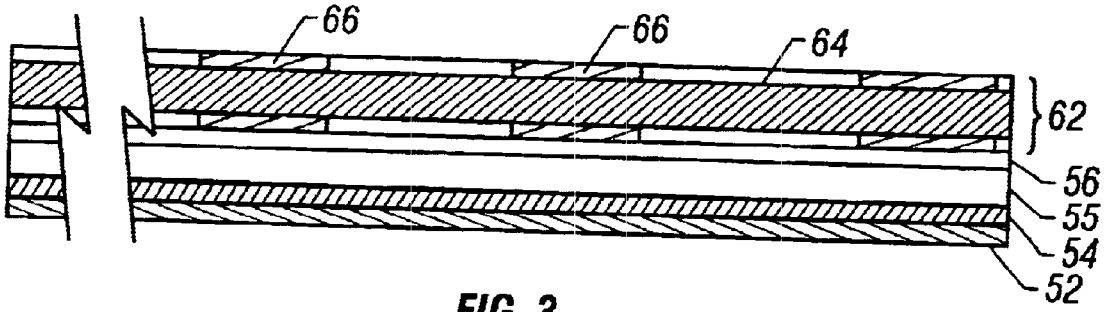
FIG. 3 is a partial cross sectional, side elevational view of the sand screen of FIG. 2.

FIGS. 2 and 3 show embodiments of the present invention that may be used in a well. The sand screen 50 generally comprises a base pipe 52 surrounded by a screen 54. To provide for the flow of fluid into the base pipe 52, it has perforations therethrough. The screen 54 is typical to those used in wells such as those formed of a screen wrap or mesh designed to control the flow of sand therethrough. Surrounding at least a portion of the base pipe 52 and screen 54 is a perforated shroud 56. The shroud 56 is attached to the base pipe 52 by, for example, a connecting ring or other connecting member extending therebetween and connected by a known method such as welding. The shroud 56 and the screen 54 define a space therebetween 55.

In the embodiment shown in FIG. 2, the sand screen 50 comprises a plurality of shunt tubes 58 (also known as alternate paths) positioned in the space 55 between the screen 57 and the shroud 56. The shunt tubes 58 are shown attached to the base pipe 52 by an attachment ring 60. The methods and devices of attaching the shunt tubes 58 to the base pipe 52 may be replaced by any one of numerous equivalent alternatives, only some of which are disclosed in the specification. The shunt tubes 58 can be used to transport gravel laden slurry during a gravel pack operation, thus reducing the likelihood of gravel bridging and providing improved gravel coverage across the zone to be gravel packed. The shunt tubes 58 can also be used to distribute treating fluids more evenly throughout the producing zone, such as during an acid stimulation treatment.

The shroud 56 comprises at least one channel 62 therein. The channel 62 is an indented area in the shroud 56 that extends along its length linearly, helically, or in other traversing paths. The channel 62 in one alternative embodiment has a depth sufficient to accommodate a control line 64 therein and allow the control line 64 to not extend beyond the outer diameter of the shroud 56. Other alternative embodiments may allow a portion of the control line 64 to extend from the channel 62 and beyond the outer diameter of the shroud 56 without damaging the control line 64. In another alternative, the channel 62 includes an outer cover (not shown) that encloses at least a portion of the channel 62.

To protect the control line 64 and maintain it in the channel 62, the sand screen 50 may comprise one or more cable protectors, or restraining elements, or clips, 66. The clips 66 attach to the shroud in the channel 62 and are adapted to selectively receive and hold a control line 64 therein. In the embodiment shown in FIG. 2, the clip 66 has a dovetail groove forming a mouth with a smaller width than the inner portion of the clip 66. In this embodiment, the control line 64 is noncircular and capable of fitting through the mouth in one orientation after which it is reoriented so that it cannot pass through the mouth. Thereby the control line 64 is held in the clip 66.

Figure 4:
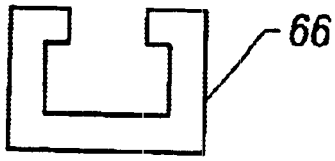
FIG. 4 is a side elevational view of a restraining element and cable protector that may be used with the sand screen.

FIG. 4 shows an alternative embodiment wherein the groove in the clip 66 is rectangular rather than dovetail shaped. Note that the clip 66 may be formed with resilient sides to allow a control line 64 to be snapped into position. In the embodiments shown, the clip 66 has a length such that holds a significant length of the control line 64. The clips 66 shown may be replaced by any one of numerous equivalent alternatives, only some of which are disclosed in the specification. In general, any device or method capable of holding the control line 64 in the channel 62 may be used, and are herein referred to as restraining elements 66. The restraining element 66 can be a single unit having a length that is as long as the longitudinal length of the channel 62. Alternately, multiple restraining elements 66 of shorter length can be utilized, such as shown in FIG. 3.

Figure 5:
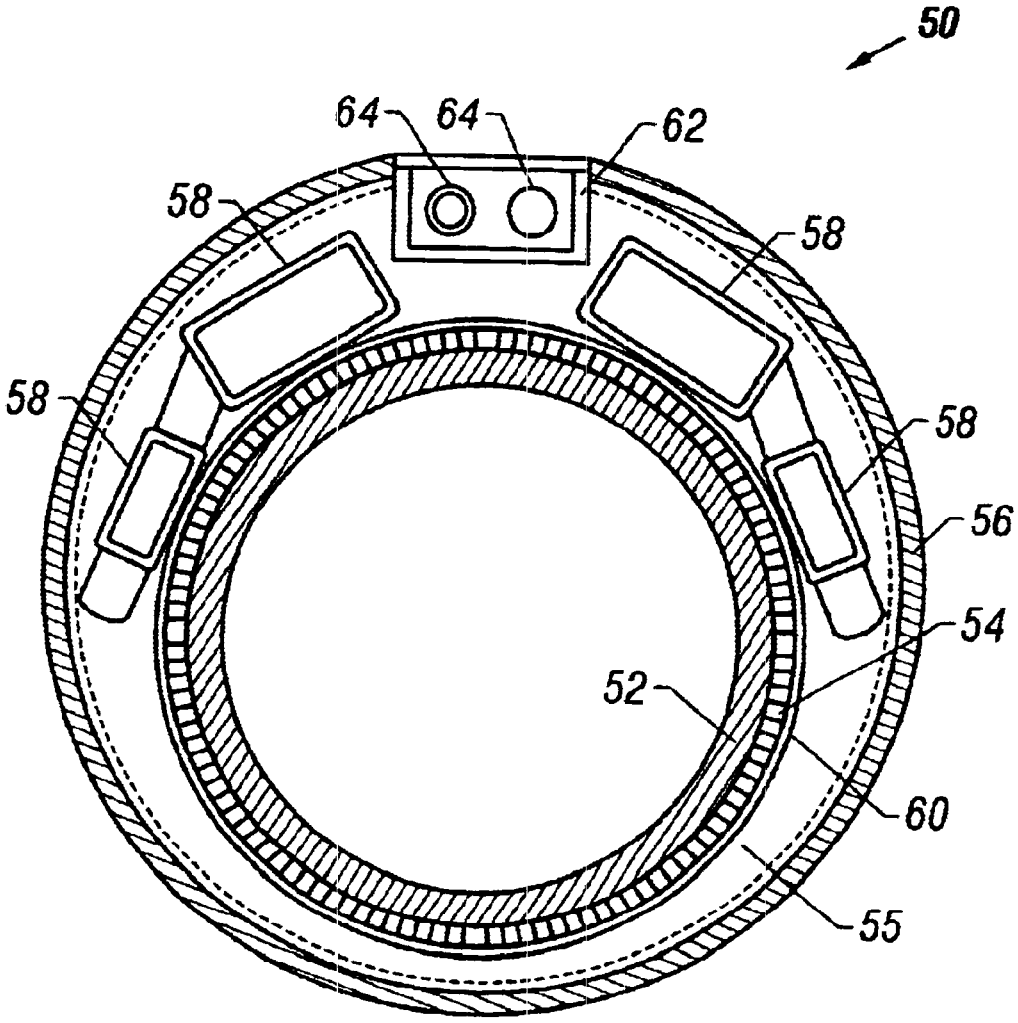
FIG. 5 is a cross sectional view of an embodiment of the invention comprising a sand screen having a control line channel formed therein.

FIG. 5 shows an alternative embodiment in which the channel 62, or control line passageway, is fully enclosed. This alternative embodiment is illustrative in showing the channel 62 or control line passageway may take may forms from an open channel to a fully encircled channel. Further, although shown as a channel having square corners, the channel may be rounded or otherwise configured. FIG. 5 also illustrates that the channel may house a plurality of control lines 64 therein.

Note that, as used herein, control line 64 includes fiber optic lines, hydraulic lines, electrical lines, other types of control lines used in wells, and combinations thereof. The control line 64 may be used to power or communicate with, collectively referred to as telemetering, a device placed in the well. The devices may include any device commonly controlled by a control line in a well, such as intelligent completion devices, valves, meters, sensors, gauges, and other devices.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

I claim:

1. A sand screen, comprising:

a shroud having a channel formed therein, wherein the channel is formed in a body of the shroud along a longitudinal direction of the shroud.

2. The sand screen of claim 1, further comprising:

a restraining element adapted to maintain one or more control lines within the channel.

3. The sand screen of claim 1, further comprising:

at least one alternate path positioned within the shroud.

4. The sand screen of claim 1, further comprising:

a base pipe, wherein the shroud is attached to the base pipe by a connecting member.

5. The sand screen of claim 1, further comprising:

a screen, wherein the shroud at least partially surrounds the screen and defines a space between them.

6. The sand screen of claim 5, wherein at least one alternate path is positioned within the space between the shroud and the screen.

7. The sand screen of claim 1, wherein the shroud is perforated.

8. The sand screen of claim 1, wherein the channel is fully enclosed.

9. The sand screen of claim 1, wherein the channel comprises an indented area in the shroud.

10. The shroud of claim 1, wherein the channel comprises an indented area in the shroud.

11. The shroud of claim 10, wherein the indented area is defined in the body.

12. A downhole assembly for completing a subterranean wellbore comprising:

one or more control lines;

a sand screen;

a perforated shroud surrounding the sand screen;

a channel formed within the shroud extending along the longitudinal length of the shroud, the channel having a width and depth sufficient to contain the one or more control lines; and a connecting member attaching the shroud to the sand screen.

13. The downhole assembly of claim 12, further comprising one or more restraining elements within the channel adapted to retain the one or more control lines within the channel.

14. The downhole assembly of claim 12, further comprising at least one alternate path disposed between the sand screen and the shroud.

15. The downhole assembly of claim 12, wherein the channel is formed in a body of the shroud along a longitudinal direction of the body.

16. The downhole assembly of claim 12, wherein the channel comprises an indented area of the shroud.

17. A method for routing a control line, comprising:

providing a channel in a shroud of a sand screen; and running a control line through the channel.

18. The method of claim 17, further comprising:

inserting the sand screen and control line into a subterranean wellbore.

19. The method of claim 17, further comprising:

holding the control line within the channel by a restraining element.

20. The method of claim 17, wherein providing the channel comprises providing an indented area in the shroud.

21. The method of claim 17, wherein providing the channel comprises providing the channel in a body of the shroud, the channel extending longitudinally along the shroud.

22. A method of telemetering in a well, comprising:

positioning a sand screen in the well, the sand screen having a shroud with a channel therein;

providing another device in the well; and extending a control line from the device and through the channel.

23. The method of claim 22, further comprising:

holding the control line within the channel by a restraining element.

24. A method of powering a device below a sand screen in a subterranean wellbore comprising:

providing a downhole device having a control line extending therefrom;

providing a sand screen assembly comprising a shroud having a channel;

inserting the downhole device control line into the shroud channel;

inserting the downhole device and sand screen assembly into the wellbore; and controlling the downhole device through the control line.

25. The method of claim 24, further comprising:

holding the control line within the channel by a restraining element.

26. A method for completing a subterranean wellbore comprising:

providing a downhole device having a control line extending therefrom;

providing a downhole assembly having a sand screen, a perforated shroud surrounding the sand screen, a channel disposed within the shroud extending along the longitudinal length of the shroud, the channel having a width and depth sufficient to contain one or more control lines and one or more restraining elements within the channel adapted to retain the one or more control lines within the channel and at least one alternate path disposed between the sand screen and the shroud;

inserting the downhole device control line into the shroud channel;

inserting the downhole device and sand screen assembly into the wellbore; and controlling the downhole device through the control line.

27. The method of claim 26, further comprising performing a gravel pack operation after inserting the downhole device and sand screen assembly into the wellbore.

28. A sand screen, comprising:

a shroud having a channel formed therein;

a base pipe and a screen element around the base pipe, wherein a space is defined between the screen element and the shroud, and the channel being separate from the space.

29. The sand screen of claim 28, further comprising a shunt tube extending through the space.

30. A shroud for a sand screen, comprising:

a body; and a channel, wherein the channel is formed in the body of the shroud along a longitudinal direction of the shroud, the channel having a length to receive a control line.

31. The shroud of claim 30, further comprising one or more restraining elements adapted to retain the control line within the channel.

32. The shroud of claim wherein 30, the shroud has an outer diameter and the channel has a depth sufficient to contain the control line so that the control line does not extend beyond the outer diameter of the shroud.

33. The shroud of claim 30, further comprising:

a connecting member attaching the shroud to the sand screen.

34. The shroud of claim 30, wherein at least one alternate flow path element is located between the shroud and the sand screen.

35. The sand screen of claim 30, wherein the channel is fully enclosed.

36. A downhole assembly for completing a subterranean wellbore comprising:

a sand screen;

a perforated shroud surrounding the sand screen;

a channel formed within the shroud extending along the longitudinal length of the shroud, the channel having a width and depth sufficient to contain one or more control lines; and a connecting member attaching the shroud to the sand screen; and at least one alternate path disposed between the sand screen and the shroud, wherein the alternate path comprises a shunt tube.

37. An apparatus comprising:

a sand screen;

a shroud having a channel formed therein; and a control line extending in the channel.

38. The apparatus of claim 37, wherein the shroud has a body, the channel formed in the body.

39. The apparatus of claim 37, further comprising a shunt tube between the shroud and the sand screen.

* * * * *